US009045907B2

(12) United States Patent
Clark et al.

(10) Patent No.: US 9,045,907 B2
(45) Date of Patent: Jun. 2, 2015

(54) HEATED ROOF PANEL

(75) Inventors: Larry Clark, Salt Lake City, UT (US); Bruce Bain, Salt Lake City, UT (US); Robyn Perry, West Jordan, UT (US)

(73) Assignee: Valin Corporation, San Jose, CA (US)

( * ) Notice: Subject to any disclaimer, the term of this patent is extended or adjusted under 35 U.S.C. 154(b) by 242 days.

(21) Appl. No.: 13/151,567

(22) Filed: Jun. 2, 2011

(65) Prior Publication Data

US 2011/0297662 A1 Dec. 8, 2011

Related U.S. Application Data

(60) Provisional application No. 61/351,198, filed on Jun. 3, 2010.

(51) Int. Cl.

| | |
|---|---|
| ***H05B 1/00*** | (2006.01) |
| ***H05B 3/06*** | (2006.01) |
| ***E04D 13/10*** | (2006.01) |

(52) U.S. Cl.

CPC ..... *E04D 13/103* (2013.01); *H05B 2214/02* (2013.01)

(58) Field of Classification Search

CPC ..... E04D 13/103; H05B 2214/02

USPC ..... 219/213, 534, 549

See application file for complete search history.

(56) References Cited

U.S. PATENT DOCUMENTS

| | | | | |
|---|---|---|---|---|
| 4,258,703 | A * | 3/1981 | Reitmaier | 126/623 |
| 5,391,858 | A * | 2/1995 | Tourangeau et al. | 219/213 |
| 6,348,673 | B2 * | 2/2002 | Winters | 219/213 |
| 6,708,452 | B1 * | 3/2004 | Tenute | 52/11 |
| 6,759,630 | B1 * | 7/2004 | Tenute | 219/213 |
| 6,852,951 | B2 * | 2/2005 | Heise | 219/213 |
| 7,071,446 | B1 * | 7/2006 | Bench | 219/213 |
| 2001/0032834 | A1 * | 10/2001 | Winters | 219/213 |
| 2003/0213796 | A1 * | 11/2003 | Heise | 219/535 |
| 2004/0035853 | A1 * | 2/2004 | Pais | 219/548 |
| 2010/0024324 | A1 * | 2/2010 | Meinzer | 52/173.1 |
| 2010/0287846 | A1 * | 11/2010 | Lenney | 52/12 |

* cited by examiner

*Primary Examiner* — Tu B Hoang
*Assistant Examiner* — Alba Rosario-Aponte
(74) *Attorney, Agent, or Firm* — Stoel Rives LLP

(57) ABSTRACT

A heated roof panel system which may be configured to control snow or ice build-up on a roof. The system may include heated elements and cladding elements configured to surround the heated elements. Further, the system may incorporate a snap-fit design configured to cover any points where portions of the system are pierced by fasteners.

18 Claims, 9 Drawing Sheets

HEATED ROOF PANEL

RELATED APPLICATIONS

This utility application claims priority to, and hereby incorporates by reference, U.S. Provisional Application No. 61/351,198, filed on Jun. 3, 2010 entitled "Heated Roof Panel."

TECHNICAL FIELD

The field of this disclosure relates to heating devices, particularly to heated roof panels that inhibit snow and ice from building up on roofs of buildings.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

Heated roof panels may be configured with inserts and cladding configured to protect the components of the system and transfer heat to snow, ice, or water on a roof. In some instances panels may be designed as part of an expandable system, with multiple panels configured to be installed to cover a portion of a roof. Moreover, panels may be configured such that outer portions of the panels create a sealed cladding system, which may be configured to reduce the potential for leaks.

It will be readily understood that the components of the embodiments, as generally described and illustrated in the figures herein, could be arranged and designed in a variety of configurations. Thus, the following more detailed description of various embodiments, as represented in the figures, is not intended to limit the scope of the disclosure, but is merely representative of various embodiments. While the various aspects of the embodiments are presented in drawings, the drawings are not necessarily drawn to scale unless specifically indicated.

With reference to the above-listed drawings, this section describes particular embodiments and their detailed construction and operation. The embodiments described herein are set forth by way of illustration only and not limitation. Skilled persons will recognize, in light of the teachings herein, that there is a range of equivalents to the example embodiments described herein. Most notably, other embodiments are possible, variations can be made to the embodiments described herein, and there may be equivalents to the components, parts, or steps that make up the described embodiments.

For the sake of clarity and conciseness, certain aspects of components or steps of certain embodiments are presented without undue detail where such detail would be apparent to skilled persons in light of the teachings herein and/or where such detail would obfuscate an understanding of more pertinent aspects of the embodiments.

The phrases "connected to," "coupled to," and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

Figure 1:
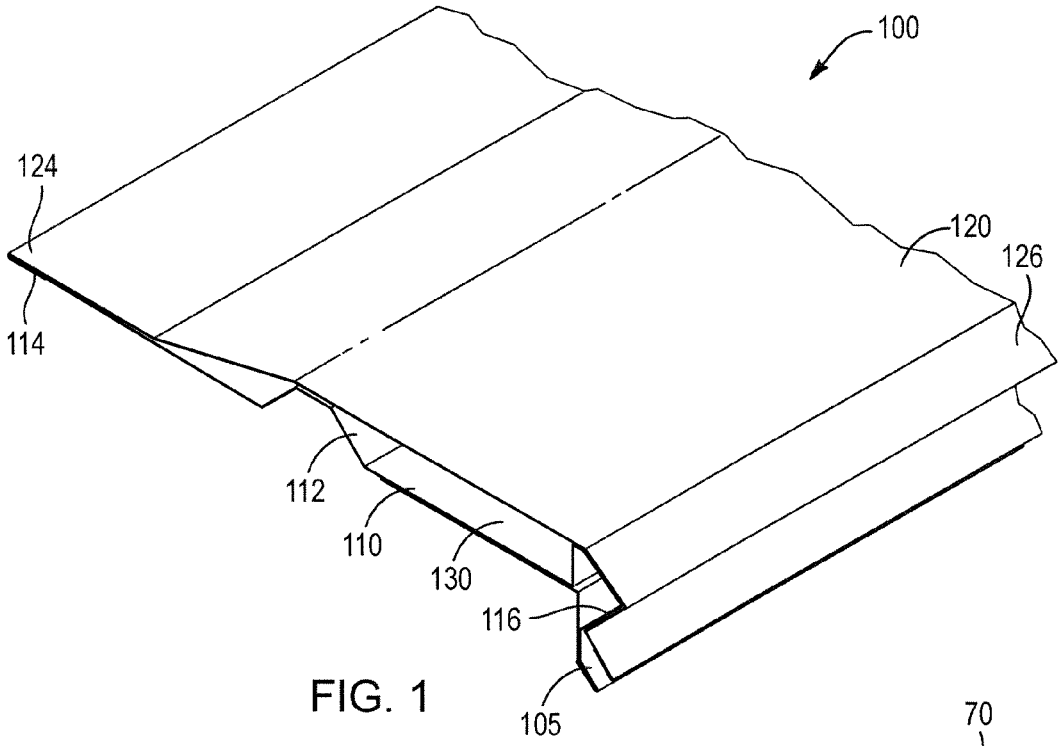
FIG. 1 is a fragmentary perspective view of a roof panel, according to one embodiment, for heating a portion of a roof.

FIG. 1 is a fragmentary perspective view of a roof panel 100, according to one embodiment, for heating a portion of a roof. In one embodiment, the roof panel is configured to attach to an outer margin (e.g., an eave) of a roof. The illustrated roof panel 100 comprises a bottom member 110 coupled to a top member 120. A cavity 130 is present between the bottom member 110 and the top member 120. As discussed in more detail below, a heated insert (not shown in FIG. 1) may be configured to be disposed within the cavity 130.

In some embodiments the roof panel 100 may be coupled to a roof (not shown) by fastening the bottom member 110 to a portion of the roof. The bottom member 110 may be disposed substantially flat along the roof and may be coupled to the roof through any means, including adhesives, nails, screws, clips, and so on. The bottom member 110 may further be configured with one or more ridges 112. Such ridges 112 may provide support and rigidity to the roof panel 100. For example, in some instance the ridge 112 may transfer a load placed on the top member 120 of the roof panel 100 to the bottom member 110 and then to the roof. As another example, in some embodiments the ridge 112 may prevent the top member 120 from buckling or crushing when it is stepped on.

The top member 120 may be configured with an upper locking portion 124 configured to couple the top member 120 to an upper locking portion 114 of the bottom member 110. Similarly, the top member 120 may further be coupled to the bottom member 110 by a lower locking portion 126 of the top member 120 and a lower locking portion 116 of the bottom member 110.

In some embodiments, the roof panel 100 may be configured such that any and all points at which the roof panel 100 is pierced by an attachment component (such as a screw or a nail) are covered by a portion of the roof panel 100. For example, the bottom member 110 of a roof panel 100 may be coupled to the roof by roofing nails. The top member 120 may be configured to cover the top surface of the bottom member 110, thereby also covering each roofing nail. The upper locking portions 114, 124 and the lower locking portions 116, 126 may then be utilized to couple the top member 120 to the bottom member 110 without piercing the top member 120. Thus, the roof panel 100 may be designed as a sealed unit. In some embodiments, attachment points in the bottom member 110 may still be sealed (though use of silicone, tar, rubber washers, and so on) notwithstanding the sealing effect of the top member 120.

In some embodiments a roof panel 100 may also comprise a drip edge component 105. The drip edge component 105 may be configured to couple to the roof under the bottom member 110. In some embodiments, attachment components, such as nails, may extend from the top surface of the bottom member 110, through both the bottom member 110 and a portion of the drip edge component 105 and into the roof. The drip edge component 105 may be configured to allow the roof panel 100 to work in connection with other roofing components such as fascia, rain gutters, and so on.

Figure 2:
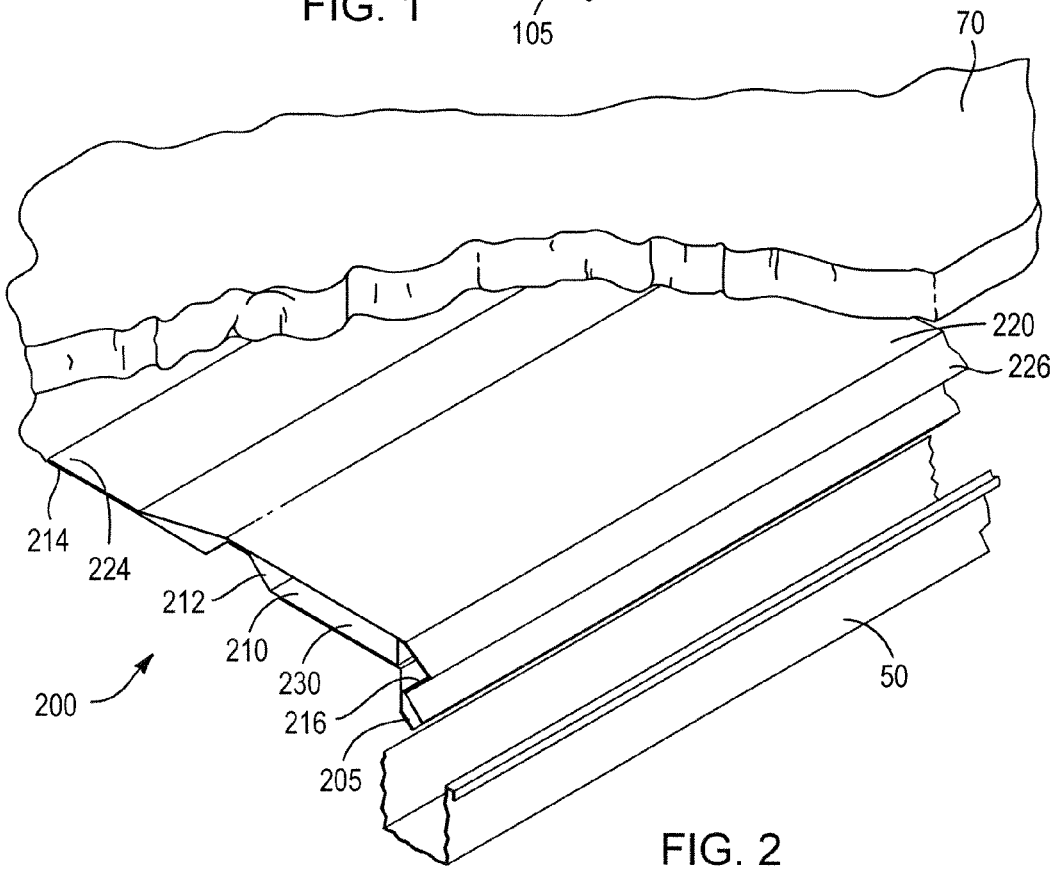
FIG. 2 is a fragmentary perspective view of another embodiment of a roof panel, oriented as if it were installed on an outer margin of a roof.

FIG. 2 is a fragmentary perspective view of another embodiment roof panel 200 that can, in certain respects, resemble components of the roof panel 100 described in connection with FIG. 1 above. It will be appreciated that all the illustrated embodiments may have analogous features. Accordingly, like features are designated with like reference numerals, with the leading digits incremented to "2." (For instance, the roof panel is designated "100" in FIG. 1 and an analogous roof panel is designated "200" in FIG. 2.) Relevant disclosure set forth above regarding similarly identified features thus may not be repeated hereafter. Moreover, specific features of the roof panel and related components shown in FIG. 2 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the roof panel of FIG. 2. Any suitable combination of the features, and variations of the same, described with respect to the roof panel and components illustrated in FIG. 1 can be employed with the roof panel and components of FIG. 2, and vice versa. This pattern of disclosure applies equally to further embodiments depicted in subsequent figures and described hereafter.

FIG. 2 is another embodiment of a roof panel 200, oriented as if it were installed on an outer margin of a roof. Like the roof panel of FIG. 1, roof panel 200 is comprised of a bottom member 210 and a top member 220 coupled to each other by upper locking portions 214, 224 and lower locking portions 216, 226. The bottom member 210 includes a ridge 212. The roof panel 200 also comprises a cavity 230 disposed between the top member 220 and the bottom member 210. Further, the roof panel 200 includes a drip edge component 205.

The drip edge component 205 may be configured to allow the roof panel 200 to work in connection with other roofing components. For example, FIG. 2 illustrates a rain gutter 50 disposed such that water running off the top member 220 and onto the drip edge component 205 will fall into the rain gutter 50. Providing a drip edge component 205 as part of the roof panel 200 may enable the roof panel 200 to function in connection with other components without the need to couple such components in a manner that would pierce the top member 220 of the roof panel 200. Thus, the drip edge component 205 may function to allow the roof panel 200 to interface with roofing components such as rain gutters 50 or fascia (not shown).

In some embodiments, the roof panel 200 may be configured to be heated. In particular, in some embodiments the cavity 230 may be configured to receive a heating element such as heating coils, hydronic tubing, or other components that may further be configured to accommodate heating elements. In some embodiments, the roof panel 200 may be configured with more than one such cavity 230.

Heat generated, transferred, or stored in elements disposed with the cavity 230 may then be transferred to the other components of the roof panel 200, including the top member 220. Heating the top member 220 may be configured to remove snow or ice build-up on the panel, or to prevent water on the panel from freezing at all. In the embodiment of FIG. 2, snow 70 is shown on a portion of the top member 220. Heat generated, transferred, or stored within the cavity may be used to melt the snow 70 as described above.

Figure 3:
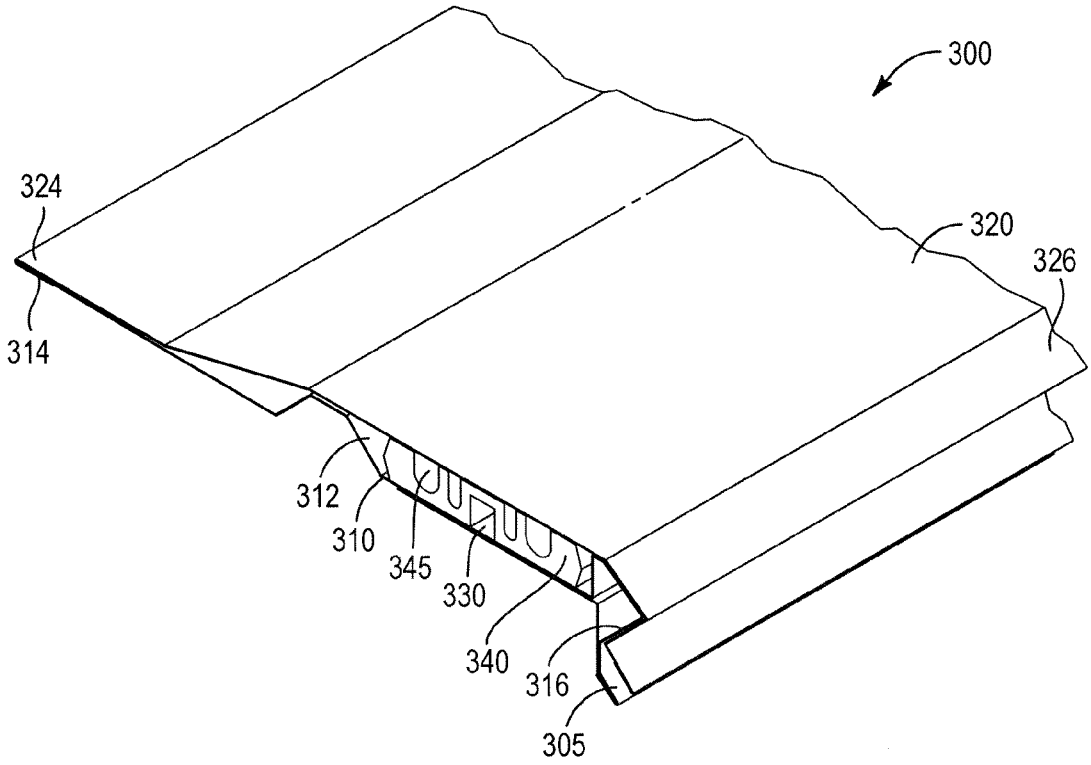
FIG. 3 is a fragmentary perspective of another embodiment of a roof panel, including a heated insert.

FIG. 3 is a fragmentary perspective of another embodiment of a roof panel 300, including a heated insert 340. Like roof panels disclosed herein, roof panel 300 is comprised of a bottom member 310 and a top member 320 coupled to each other by upper locking portions 314, 324 and lower locking portions 316, 326. The bottom member 310 includes a ridge 312. The roof panel 300 also comprises a cavity 330 disposed between the top member 320 and the bottom member 310. Further, the roof panel 300 includes a drip edge component 305.

The heated insert 340 is disposed within the cavity 330. As disclosed above, the heated insert 340 may be part of a system configured to generate, transfer, or store heat. The heated insert 340 may thus transfer heat to other components of the roof panel 300 in order to heat the roof panel 300 to melt snow and ice, or prevent such from forming. Thus, in some embodiments, external elements of the roof panel, such as the bottom member 310, top member 320, or drip edge 305 may be constructed of materials with relatively high thermal conductivity. For example, these elements may be made of 24 gauge steel in some embodiments.

Additionally, portions of the roof panel 300 may be configured to surround and protect the heating elements used in connection with the heated insert 340. As used herein, components such as the bottom member 310, top member 320, and drip edge component 305 that surround the heated insert 340 may be referred to as cladding components. The cladding components may form a barrier between snow, ice, water, sunlight, and other environmental elements and the heated insert 340. Analogous to how the cladding components can be configured to seal attachment points between the roof panel 300 and the roof, the cladding components can thus seal the heated insert 340. The cladding components may be coated with a KYNAR® finish, which may increase the durability of the components.

In some embodiments the heated insert 340 may be configured with channels 345. These channels 345 may be configured to receive heating elements, such as heating coils, wires, hydronic tubing, and so on. The channels 345 may function in connection with the cladding components to protect the heating elements. For example, a heating coil disposed within a channel would be protected from loads on the top surface of the roof panel as the top member 320 would transfer the load to the heated insert 340 and the bottom member 310, while the coils disposed within the channel 345 would not be subjected to the load. Thus, for instance, if a person were to step on a portion of the roof with included heating coils, the roof panel 300 would protect the coils from the load.

Figure 4A:
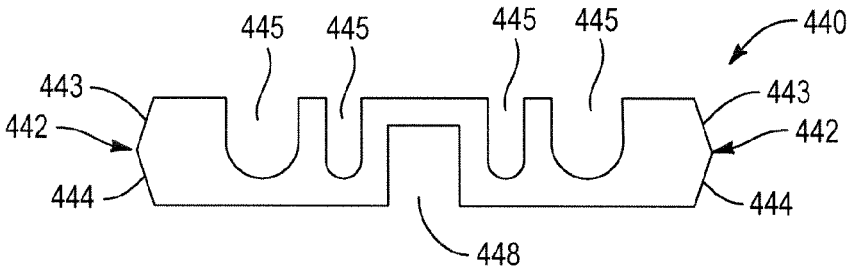
FIG. 4A is a cross-sectional view of one embodiment of a heated insert.
Figure 4B:
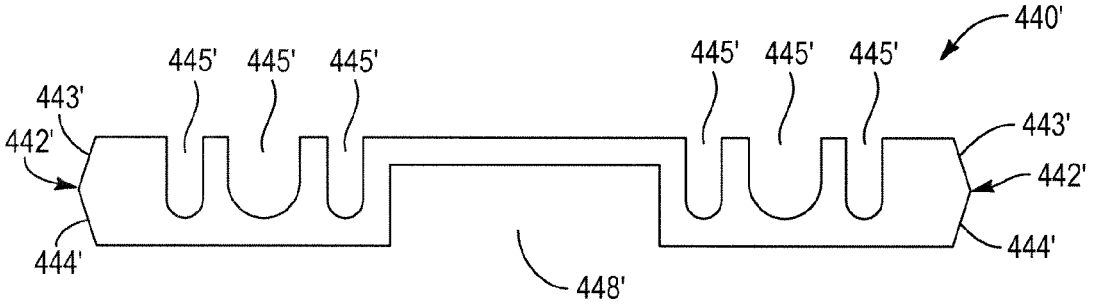
FIG. 4B is a cross-sectional view of a second embodiment of a heated insert.
Figure 4C:
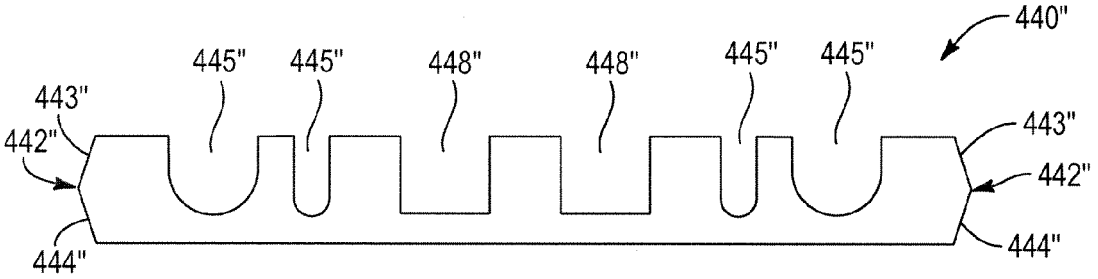
FIG. 4C is a cross-sectional view of a third embodiment of a heated insert.

FIG. 4A is a cross-sectional view of one embodiment of a heated insert 400. FIGS. 4B and 4C are cross-sectional views of further embodiments of heated inserts 400' and 400". Each heated insert 400, 400', 400" may have analogous components. Thus, while the majority of the current disclosure may refer specifically to one heated insert, the disclosure is equally relevant to analogous components of the other inserts, unless otherwise stated. (For example, disclosure provided in connection with element 445 is applicable to elements 445' and 445".)

In some embodiments, the heated insert may be composed of aluminum and formed by extrusion. In other embodiments other materials, such as steel, copper, or composite materials, may be used. Likewise, other forming processes, such as casting, milling, or forging, may be used to form the heated insert 440.

The heated insert 440 may include channels 445 that may be configured to receive heating elements. For instance, the channels 445 may accommodate a number of heating elements, such as electrical heater cable, for example, heating coils and/or hydronic tubing. The channels may be sized to accommodate the desired heating element or combination therefor. For example, a heating system may be designed to use 0.5 inch OD PEX tubing as hydronic tubing. In such an example, one or more channels in the heated insert 440 could be configured to receive the 0.5 inch OD PEX tubing. Further, the heated insert 440 may include channels of varying sizes. In some instances, the channels 445 may be so designed such that one size of channel (for example, the smaller channels) is sized to receive heating wire while the other size (for example, the larger channels) is configured to receive hydronic tubing. In some embodiments all the channels may be the same size, while in other embodiments all channels may be different sizes.

The heated insert 440 may also include a recess 448. (Note that in the embodiment of FIG. 4C there are two recesses 448" in the top surface of the heated insert 440".) These recesses 440 may also be configured to receive heating elements in some instances.

The heated insert 440 may be formed in a variety of widths, depending on the desired application. For example, in some instances a heated insert 440 may be from about 2 inches wide to about 28 inches wide, including inserts that are about 4 inches wide to about 6.25 inches wide and inserts that are about 6 inches wide to about 24 inches wide. The number of channels 445 an insert can accommodate, as well as the distance between each channel, may be configured based on factors such as the size of the heated insert 440, the anticipated heating load, and so on.

The heated insert 440 may also include a temperature sensor (not shown) to monitor and control the temperature of heated insert 440 and/or cladding elements when the roof panel is in use. The temperature sensor may be in communication with a control system (not shown) and may be configured to optimize energy consumption.

The heated insert 440 may also be configured with a side locking portion 442 on each side of the heated insert 440. The side locking portions 442 may have a generally convex shape and be formed by a first portion 443 intersecting a second portion 444 at an angle. As disclosed below, these side locking portions 442 may be used to couple other elements to the heated insert 440. In some embodiments the heated insert 440 may only have a locking portion 442 on one side. Furthermore, though the side locking portion 442 is shown having a generally convex shape, it is within the scope of this disclosure to create a similar feature utilizing a concave shape.

Figure 5A:
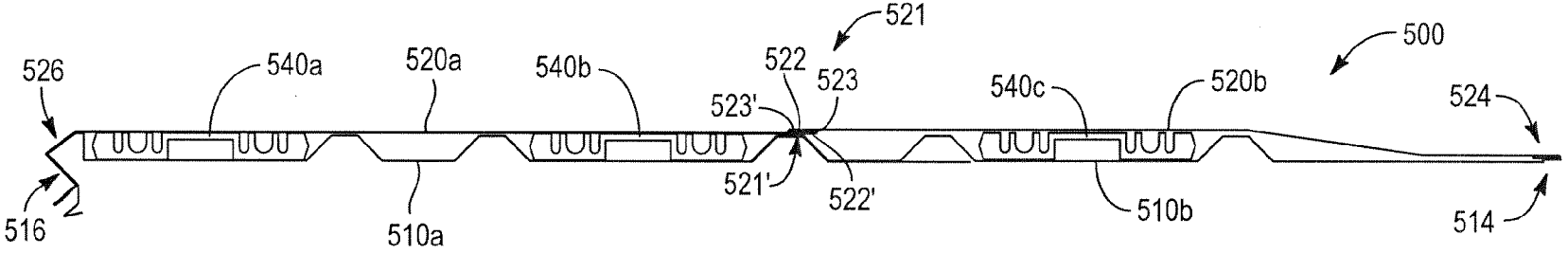
FIG. 5A is an assembled view of a heated roof panel.
Figure 5B:
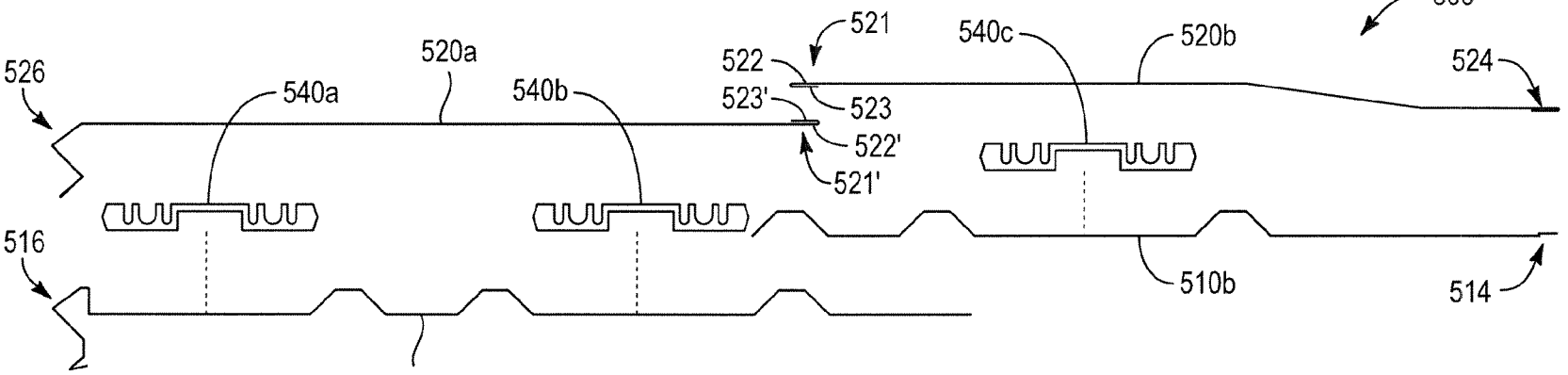
FIG. 5B is an exploded view of the heated roof panel of FIG. 5A.

FIG. 5A is an assembled view of a heated roof panel 500, and FIG. 5B is an exploded view of the same heated roof panel 500. In the embodiment of FIG. 5, the roof panel comprises a first top member 520*a*, a second top member 520*b*, a first bottom member 510*a*, and a second bottom member 510*b*. Further, the roof panel 500 comprises three heated inserts 540*a*, 540*b*, and 540*c*.

The first top member 520*a* may be configured to couple to the second top member 520*b* through an expansion joint 521, 521' on each piece. The expansion joints 521, 521' may be formed by a bend on each of the first top member 520*a* and the second top member 520*b*. Each bend may define an inside slot portion 522, 522' and a tab portion 523, 523'. The tab 523 of the second top member 520*b* may slide into the slot 522' of the first top member 520*a* and the tab 523' of the second top member 520*b* into the slot 522 of the first top member 520*a*. In this manner the first 520*a* and second 520*b* top members may be coupled together by a partially overlapping expansion joint 521, 521'. The joints 521, 521' are such that when one or both of the first 520*a* and second top member 520*b* move (for instance due to thermal expansion) the tabs 523, 523' may slide within the slots 522, 522' without separating. Thus, in some embodiments the system may comprise expansion joints that are configured to seal without the use of fasteners. In the illustrated embodiment, the second top member 520*b* is configured to couple to the upper portion of the first bottom member 520*a* such that the second top member 520*b* is disposed over the first top member 520*a*. Such an arrangement may be configured to prevent water on the roof from seeping below the top members 520*a*, 520*b*.

In the illustrated embodiment, the first bottom member 510*a* and second bottom member 510*b* are configured to couple to each other by the second bottom member 510*b* overlapping the first bottom member 510*a*. Ridges or other features of each bottom member 510*a*, 510*b* may be configured with the similar profiles to aid in coupling the pieces. Further, because the bottom members 510*a*, 510*b* may be directly fasted to the roof, in some embodiments a fastener such as a nail or screw may be positioned to pass through both the first 510*a* and second 510*b* bottom members. In other embodiments the first 510*a* and second 510*b* bottom members may be configured with an expansion joint similar to the joint 522 or by other methods.

The first top member 520*a* has a lower locking portion 526 and the second top member has an upper locking portion 524. Like other embodiments, these portions are configured to couple the top members 520*a*, 520*b* to the bottom members 510*a*, 510*b* by coupling with a lower locking portion 516 on the first bottom member 510*a* and an upper locking portion 514 on the second bottom member 510*b*. Thus, the two top members 520*a*, 520*b* and the two bottom members 510*a*, 510*b* function together much like the single top and bottom members of other embodiments. Similarly, in some embodiments a roof panel may be composed of more than two top and two bottom members. Through use of expansion joints and overlapping joints, a system may incorporate any number of top and bottom members. Similarly, the system could likewise be configured with any number of heated inserts. Thus, in some embodiments, the system may be indefinitely expandable.

Like other embodiments disclosed herein, the embodiment of FIGS. 5A and 5B includes the upper locking portions 524, 514 and the lower locking portions 526, 516. As further disclosed below, these portions may be utilized to couple the top members 520*a*, 520*b* to the bottom members 510*a*, 510*b* without piercing the top members 520*a*, 520*b*.

Figure 6:
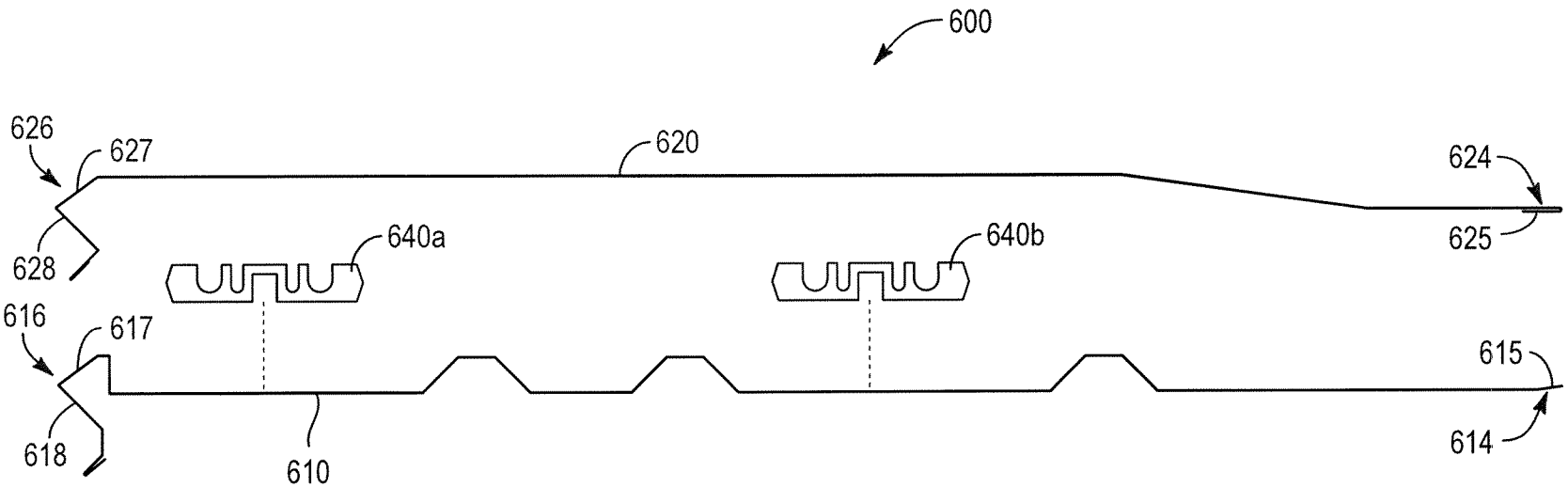
FIG. 6 is an exploded view of another embodiment of a heated roof panel.

FIG. 6 is an exploded view of another embodiment of a heated roof panel 600. The illustrated embodiment is comprised of a bottom member 610, a top member 620, and two heated inserts 640*a*, 640*b*. Again, like other embodiments herein disclosed, the top member 620 is configured to couple to the bottom member 610 through use of the upper locking portions 614, 624 and the lower locking portions 616, 626.

An upper locking portion 614 located on the bottom member 610 may be configured to couple to an upper locking portion 624 of the top member 620. The lower locking portion 614 may consist of a tab or flange 615 configured to be inserted into a slot 625 on the upper locking portion 624 of the top member. The slot 625 may be formed by a simple bend in the top member 620. In some embodiments, the bottom member 610 may initially be coupled to the roof. The upper locking portions 614, 624 may then be engage by sliding the slot 625 over the tab 615, thereby partially coupling the top member 620 to the bottom member 610. The top member 620 may be fully coupled to the bottom member by then engaging the lower locking portions 616, 626.

The lower locking portion 616 of the bottom member 610 may generally form a convex shape and comprise a first portion 617 and a second portion 618 that meet at an angle. The top member 620 lower locking portion 626 may comprise a complimentary convex shape and be formed of a first portion 627 and a second portion 628. The top member 620 and bottom member 610 may be sized such that, when the upper locking portions 614, 624 are engaged the lower locking portions 616, 626 are in line with each other. The lower locking portions 616, 626 may be engaged by slightly deforming the second portion 628 on the top member 620 such that it may pass over the first portion 617 on the bottom member 610. Once the second portion 628 is past the first portion 617, the second portion 628 may be configured to spring back such that the second portion 618 on the bottom member 610 is disposed adjacent to the second portion 628 of the top member 620. The first portions 617, 627 of each member 610, 620 may likewise be disposed adjacent to each other. Furthermore, though the disclosure above and the drawings illustrate locking portions with generally convex shapes, it is within the scope of this disclosure to create a similar feature with a concave shape.

In this manner the lower locking portions 616, 626 may be configured to "snap" together. Once the lower locking portions 616, 626 are engaged the upper locking portions 614, 624 may not be able to slip out of engagement without first displacing the lower locking portions 616, 626. Thus, in some embodiments, the system may be coupled to a roof by utilizing fasteners to couple the bottom member 610, the heated inserts 640*a*, 640*b*, and/or any other component to the roof, and "snapping" the top member 620 over the assembly to seal the system.

Figure 7A:
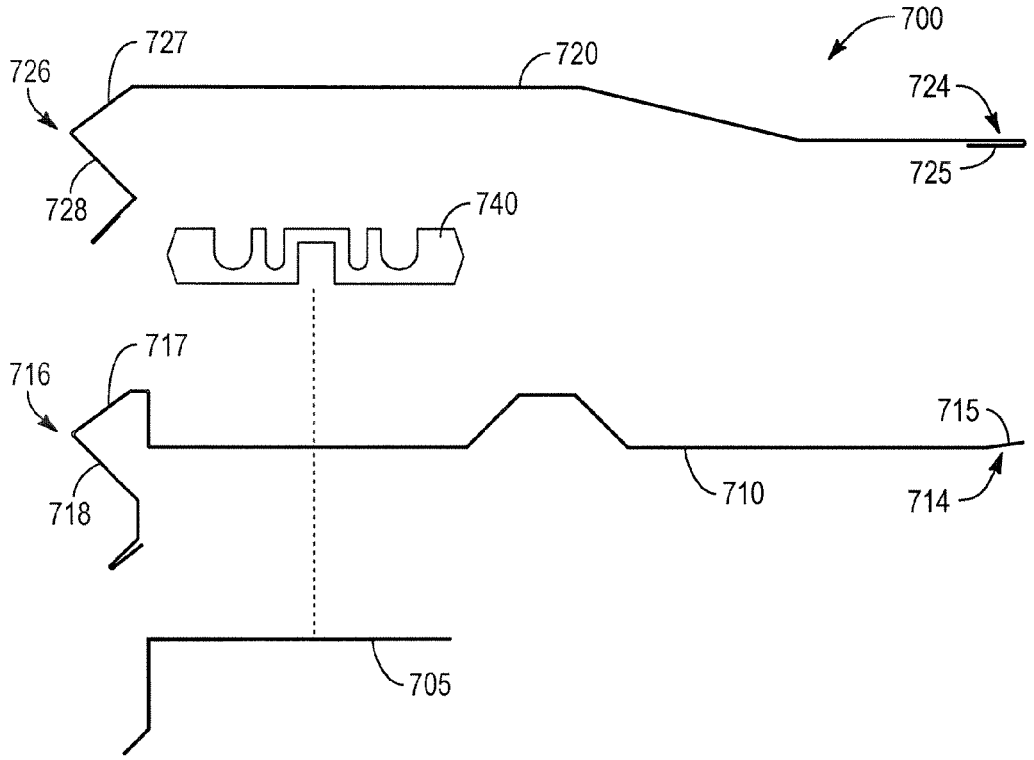
FIG. 7A is an exploded view of an embodiment of a heated roof panel including a drip edge.
Figure 7B:
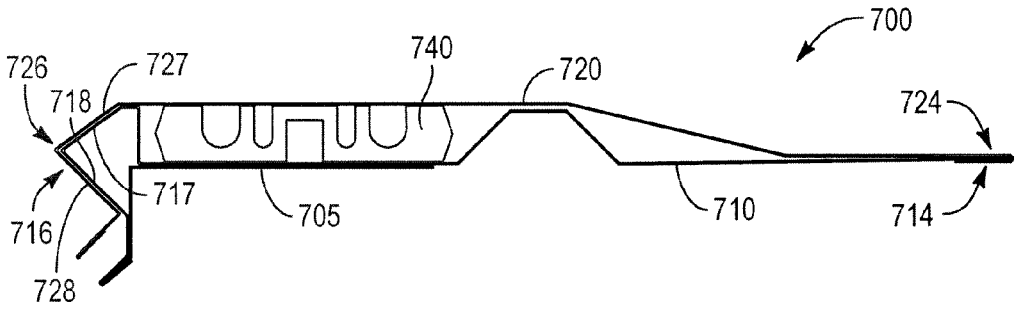
FIG. 7B is an assembled view of the heated roof panel of FIG. 7A.

FIG. 7A is an exploded view of an embodiment of a heated roof panel 700 including a drip edge 705 component, and FIG. 7B is an assembled view of heated roof panel 700. The embodiment of FIGS. 7A and 7B includes a top member 720 and a bottom member 710 as well as a heated insert 740. Further, the roof panel 700 includes upper locking portions 714, 724 and lower locking portions 716, 726. Comparison of FIGS. 7A and 7B illustrate how a tab 715 and a slot 725 of the upper locking portions 714, 724 may be engaged/disengaged and how the first 717, 727 and second 718, 728 portions of the lower locking portions 716, 726 may be disengaged and snapped into an engaged position.

Roof panel 700 also includes a drip edge component 705. Like the bottom member 710 and the heated insert 740, the drip edge 705 may be coupled to the roof in any manner, including through use of nails or screws. As in other embodiments, the top member 720 may be configured to snap over, and seal, the entire assembly.

Figure 8A:
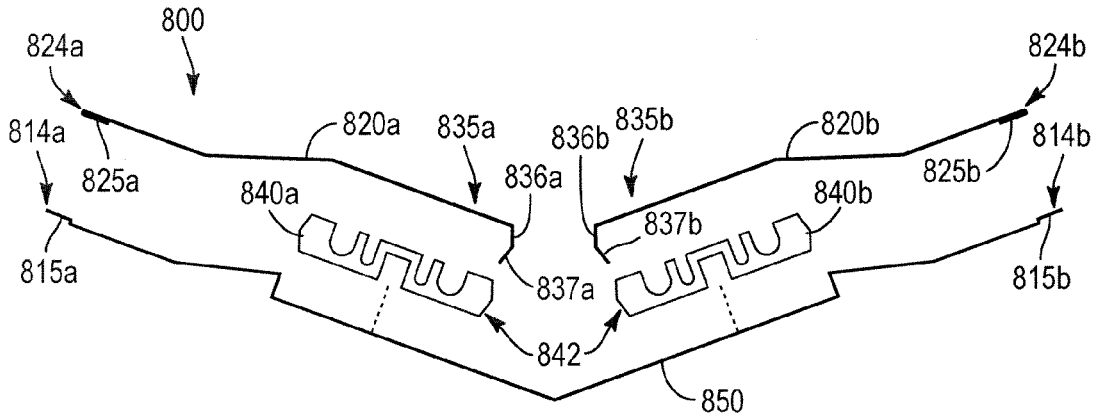
FIG. 8A is an exploded view of a heated roof panel configured for use in a roof valley.
Figure 8B:
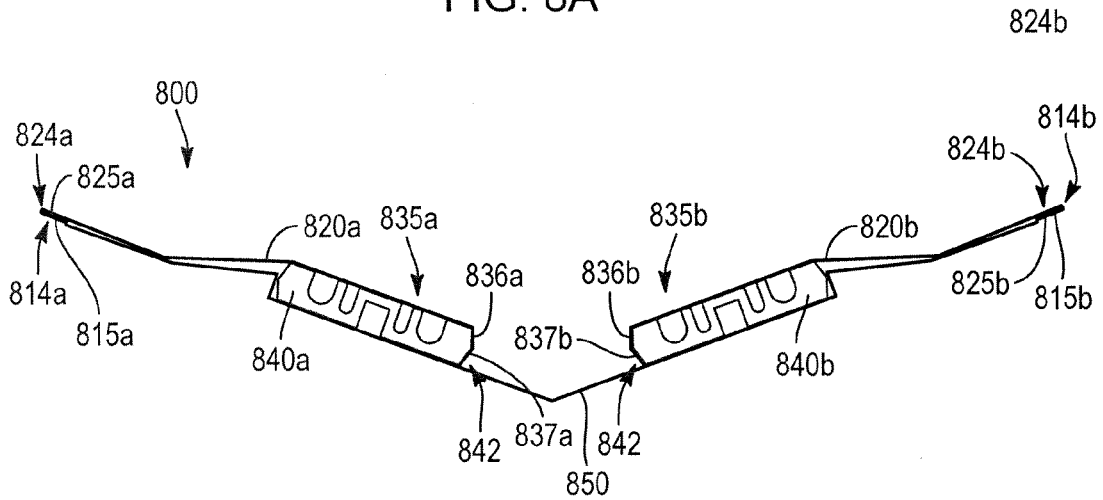
FIG. 8B is an assembled view of the heated roof panel of FIG. 8A.

FIG. 8A is an exploded view of a heated roof panel 800 configured for use in a roof valley, and FIG. 8B is an assembled view of heated roof panel 800. In the embodiment of FIGS. 8A, and 8B, the roof panel 800 has identical components on its right and left sides. Analogous components are designated by the same numeral, with an "a" following the numeral for components on the left and a "b" following the numeral for components on the right. Disclosure recited in connection with one side of the roof panel 800 is equally applicable to the other side. In some embodiments a roof panel designed for a valley may not necessarily be symmetrical.

The roof panel 800 includes a bottom member 850 as well as two top members 820*a*, 820*b* and two heated inserts 840*a*, 840*b*. The top members 820*a*, 820*b* may couple to the bottom member 850 through upper locking portions 814*a*, 814*b*, 824*a*, 824*b*, which incorporate tabs 815*a*, 815*b* and slots 825*a*, 825*b*. In some embodiments the heated inserts 840*a*, 840*b* may be coupled to the roof much as the bottom member 850. The top members 820*a*, 820*b* may also be configured with lower side locking portions 835*a*, 835*b* configured to couple to the side locking portions 842 of the heated inserts 840*a*, 840*b*. The side locking portions 835*a*, 835*b* may have first portions 836*a*, 836*b* and second portions 837*a*, 837*b* configured to snap onto similarly shaped portions of the side locking portions 842 of the heated inserts 840*a*, 840*b*.

Figure 9:
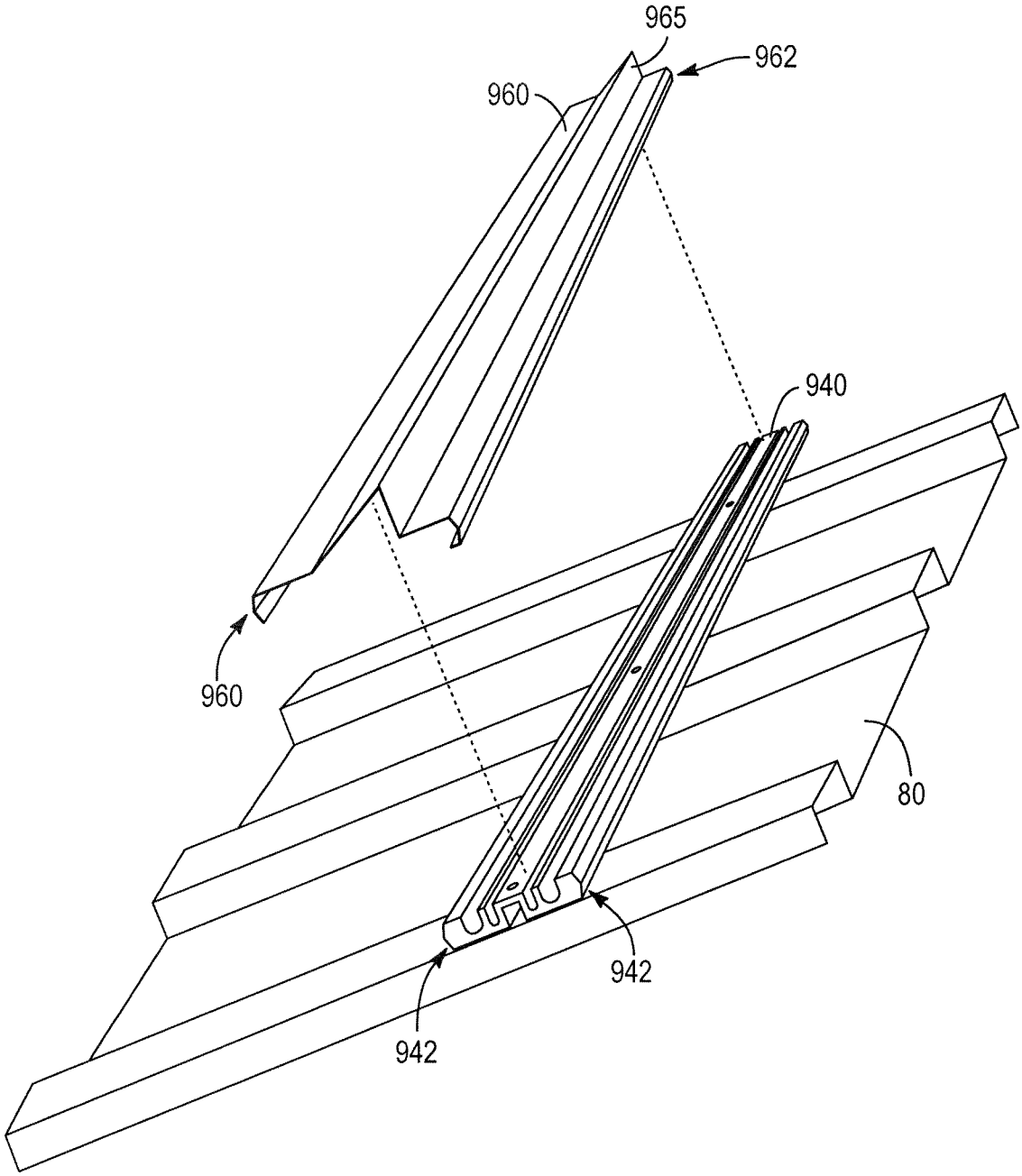
FIG. 9 is an exploded view of a heated snowfence assembly.

FIG. 9 is an exploded view of a heated snowfence assembly. The assembly includes a snowfence 960 that includes a cleat 965. The snowfence 960 may be coupled to a roof 80 such that the cleat 965 tends to prevent snow from sliding off the roof 80. In some embodiments the snowfence 960 may be used in connection with a heated insert 940. The heated insert 940 may have side lock portions 942 on each side of the heated insert 940, which may be configured to couple to similarly shaped side lock portions 962 on the snowfence 960. The snowfence 960 may thus "snap" onto the heated insert 940. In embodiments where the heated insert 940 is coupled to the roof 80 through use of fasteners that penetrate the roof 80, the snowfence 960 may be configured to enclose and seal the system.

Figure 10:
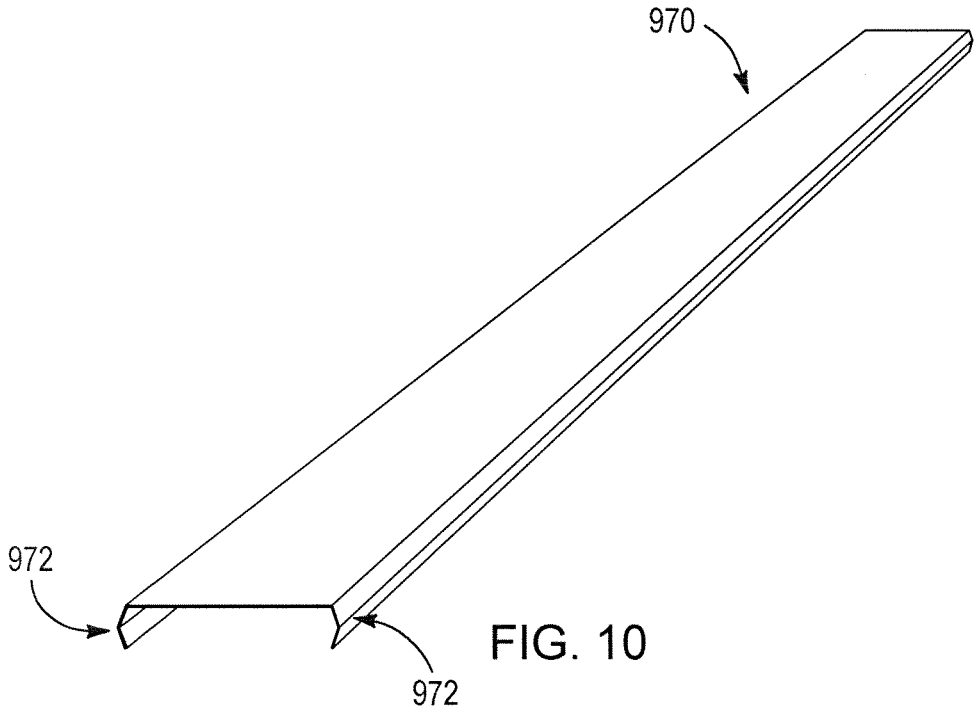
FIG. 10 is a cover configured for use with a heated roof system.

FIG. 10 is a cover 970 configured for use with a heated roof system. The cover 970 may include side lock portions 972 configured to snap onto similarly shaped portions of other components, such as a heated insert. Thus, the cover 970 of FIG. 10 may couple to a roof or other components of a heated roof system in a similar manner to the snowfence 960 of FIG. 9.

The snowfence 960 of FIG. 9 and the cover 970 of FIG. 10 may be configured for use with other components herein disclosed (such as top and bottom cladding members, valley members, and so on) or configured for use as the only heated element on a roof. Likewise, any of the components of the system herein disclosed may be used in connection with other components, in some embodiments in a modularly expanding fashion, or singly.

Figure 11:
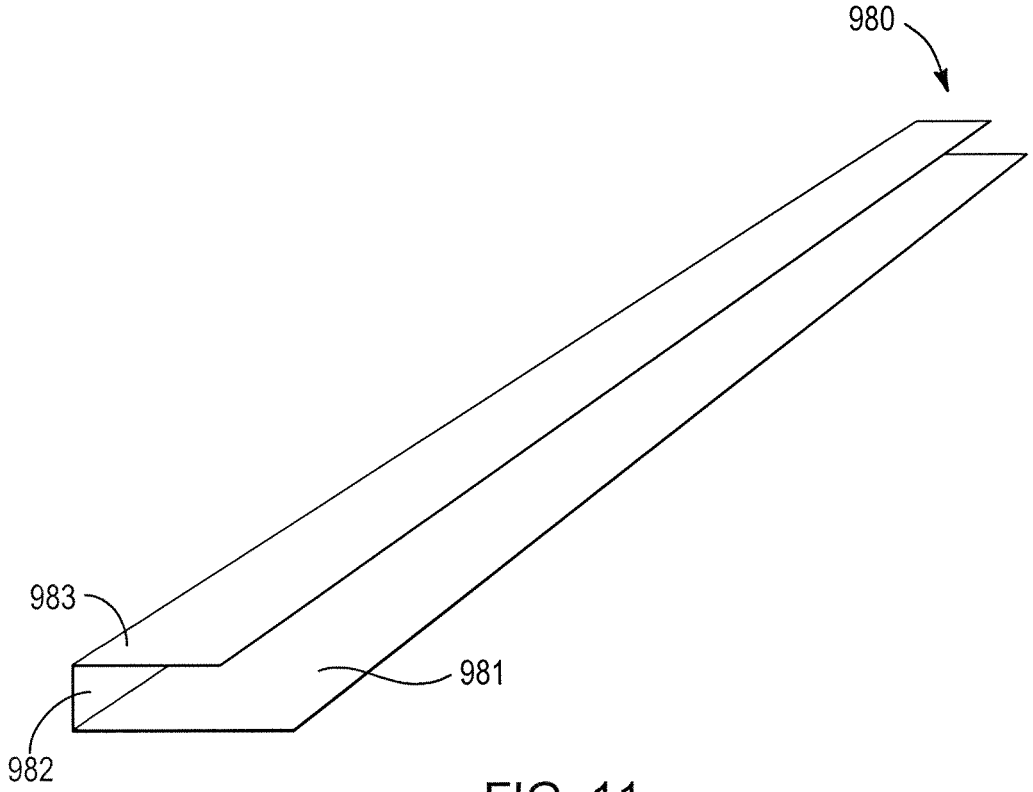
FIG. 11 is an end cap configured for use with a heated roof system.

FIG. 11 is an end cap 980 configured for use with a heated roof system. In some embodiments such an end cap 980 may be used to seal the side portions of other components herein described, such as a roof panel with a top member, a bottom member, and a heated insert, such as the roof panel of FIG. 3. The end cap 980 may be configured with a bottom flange 981 that may be configured to be coupled to a roof under a bottom member of a heated roof panel. The end cap 980 may also have a side portion 982 configured to cover and seal a side portion of a heated roof panel, for example, heated roof panels wherein the side of the heated insert is otherwise exposed. Finally, the end cap 980 may have a top flange 983 configured to be disposed below the top member of a heated roof panel.

The examples and embodiments disclosed herein are to be construed as merely illustrative and exemplary, and not a limitation of the scope of the present disclosure in any way. It will be apparent to those having skill in the art that changes may be made to the details of the above-described embodiments without departing from the underlying principles of the disclosure herein. It is intended that the scope of the invention be defined by the claims appended hereto and their equivalents.

The invention claimed is:

1. A heated roof panel comprising:

a heated insert configured to receive a heating element;

a bottom panel configured to couple to an outer margin of a roof using one or more fasteners, wherein the fasteners are configured to pierce the bottom panel to secure the heated roof panel to the roof, the bottom panel comprising a ridge having a height matching the heated insert, the bottom panel comprising an area for covering a region of a roof; and a top panel substantially a same size as the area of the bottom panel, the top panel configured to cover the heated insert and cover substantially all of the bottom panel, such that the top panel covers all points of the heated roof panel pierced by any fastener, wherein the top panel comprises a thermally conductive material, the top panel comprising, an upper locking portion on an upper edge of the top panel, the upper locking portion configured to hook over and cover a top surface of an upper edge of the bottom panel, and a lower locking portion on a lower edge of the top panel comprising a convex portion configured to couple to the bottom panel by snapping in place over a lower locking portion of the bottom panel.

2. The heated roof panel of claim 1, wherein the heated insert is disposed within a cavity formed between the top panel, the ridge of the bottom panel, and the bottom panel.

3. The heated roof panel of claim 2, wherein the heated insert is an aluminum extrusion.

4. The heated roof panel of claim 2, further comprising an end cap coupled to the roof panel and configured to cover an end of the heated insert.

5. The heated roof panel of claim 1, wherein the top panel is configured to couple to the heated insert.

6. The heated roof panel of claim 1, wherein the top panel further comprises a cleat configured to prevent snow from sliding past the cleat.

7. A roof panel to inhibit snow and ice build-up, comprising:

a bottom panel configured to couple to a roof using one or more fasteners, wherein the fasteners are configured to pierce the bottom panel to secure the roof panel to the roof;

a top panel covering substantially all of the bottom panel, such that the top panel covers all points of the roof panel pierced by any fastener, a portion of the top panel being separated from the bottom panel to form a cavity therebetween, wherein the top panel is configured to couple to the bottom panel without using piercing fasteners, wherein the bottom and the top panel comprise, first ends configured to engage to form a seal, wherein a first end of the top panel comprises a locking portion configured to hook over a first end of the bottom panel and cover a top surface of the first end of the bottom panel, and second ends distal from the first ends comprising complementary convex shaped portions configured to enable the top and bottom panels to couple together by snapping a second end of the top panel over a second end of the bottom panel; and a heated insert disposed within the cavity, the heated insert being operable to hold a heating element that heats the top panel.

8. The roof panel of claim 7, wherein the first end of the bottom panel includes a tab portion that is shaped to mate with a slot portion of the first end of the top panel.

9. The roof panel of claim 7, wherein the heated insert comprises an aluminum extrusion.

10. The roof panel of claim 7, further comprising an end cap configured to couple to the side of the roof panel.

11. A heated roof panel comprising:

a heated insert configured to receive a heating element;

a bottom panel configured to attach to an outer margin of a roof using one or more fasteners, wherein the fasteners are configured to pierce the bottom panel to secure the heated roof panel to the roof, the bottom panel comprising an area for covering a region of a roof and a raised locking portion integrated with a lower end of the bottom panel; and a top panel configured to cover the heated insert and cover substantially all of the bottom panel, such that the top panel covers all points of the roof panel pierced by any fastener, the top panel comprising, a locking portion on a lower end corresponding to the raised locking portion of the bottom panel, and a locking portion on an upper end configured to hook to a corresponding locking feature and cover a top surface of an upper end of the bottom panel;

wherein the locking portion on the lower end of the top panel and the raised locking portion of the bottom panel comprise corresponding shapes for securing the top panel to the bottom panel by snapping the lower end of the top panel over the raised locking portion of the bottom panel, and wherein the heated insert is configured to be disposed within a cavity formed between the top panel, the bottom panel, and the locking portion of the bottom panel.

12. The heated roof panel of claim 11, wherein the heated insert is disposed within a cavity between the top panel and the bottom panel.

13. The heated roof panel of claim 11, wherein the locking portion on the lower end of the top panel and the raised locking portion of the bottom panel are generally convex in shape.

14. The heated roof panel of claim 11, wherein the locking portion on the lower end of the top panel and the raised locking portion of the bottom panel are generally concave in shape.

15. The heated roof panel of claim 11, wherein the heated insert is an aluminum extrusion.

16. The heated roof panel of claim 11, wherein an upper end of the bottom panel includes a tab portion that is shaped to mate with the locking portion of the top panel comprising a slot portion, wherein the tab portion and the slot portion are located on upper ends of the bottom panel and top panel distal from the locking portion on the lower end of the top panel and the raised locking portion of the bottom panel.

17. The heated roof panel of claim 11, wherein the top panel is configured to couple to the heated insert.

18. The heated roof panel of claim 11, wherein the top panel further comprises a cleat configured to prevent snow from sliding past the cleat.

* * * * *